US005839149A

United States Patent [19]

Scheier et al.

[11] Patent Number: 5,839,149

[45] Date of Patent: Nov. 24, 1998

[54] TOOTHBRUSH WITH RESILIENT FLEXIBLE BRISTLE SUPPORT

[76] Inventors: Paul A. Scheier; Luise E. Scheier, both of 220 Central Park South, New York, N.Y. 10019

[21] Appl. No.: 702,982

[22] Filed: Aug. 26, 1996

[51] Int. Cl.[6] ..... A46B 9/01

[52] U.S. Cl. ..... 15/167.2; 15/167.1; 15/201; 15/DIG. 5

[58] Field of Search ..... 15/201, 203, 167.1, 15/167.2, 186, 187, 202, 172, DIG. 5, 160, 146

[56] References Cited

U.S. PATENT DOCUMENTS

| | | | |
|---|---|---|---|
| 229,823 | 7/1880 | Holz et al. | 15/167.2 |
| 569,870 | 12/1896 | Hamilton | 15/167.2 |
| 585,358 | 6/1897 | Gould | 15/188 |
| 864,054 | 8/1907 | Abrams | 15/167.2 |
| 1,091,291 | 3/1914 | Carroll | 15/167.2 |
| 1,353,780 | 9/1920 | Mueller | 15/167.2 |
| 1,901,646 | 3/1933 | Hicks | 15/167.1 |
| 1,908,509 | 5/1933 | Davis | 15/167.2 |
| 2,214,407 | 9/1940 | Deutsch | 15/167.2 |
| 2,244,615 | 6/1941 | Garcin | 15/167.2 |
| 2,706,825 | 4/1955 | Blakeman | 15/167.1 |
| 2,807,820 | 10/1957 | Dinhofer | 15/176.1 |
| 2,864,111 | 12/1958 | Rotceig | 15/201 |
| 3,065,479 | 11/1962 | McGee | 15/167.2 |
| 3,853,412 | 12/1974 | Griffin | 15/167.1 |
| 4,131,967 | 1/1979 | Northemann et al. | 15/167.2 |
| 4,240,452 | 12/1980 | Jean | 15/167.1 |
| 4,306,327 | 12/1981 | Zeski | 15/167.1 |
| 4,409,701 | 10/1983 | Perches | 15/167.1 |
| 4,633,542 | 1/1987 | Taravel | 15/167.1 |
| 4,712,267 | 12/1987 | Cheng | 15/201 |
| 4,884,311 | 12/1989 | Gregory | 15/167.1 |
| 5,046,212 | 9/1991 | O'Conke | 15/167.1 |
| 5,054,154 | 10/1991 | Schiffer et al. | 15/167.1 |
| 5,175,901 | 1/1993 | Rabinowitz | 15/167.2 |
| 5,213,428 | 5/1993 | Salman | 15/167.1 |
| 5,228,466 | 7/1993 | Klinkhammer | 15/167.2 |
| 5,269,038 | 12/1993 | Bradley | 15/167.1 |
| 5,284,168 | 2/1994 | Klinkhammer | 15/167.2 |
| 5,325,560 | 7/1994 | Pavone et al. | 15/167.1 |
| 5,348,153 | 9/1994 | Cole | 15/167.1 |
| 5,355,546 | 10/1994 | Scheier | 15/167.2 |
| 5,373,602 | 12/1994 | Bang | 15/167.1 |
| 5,440,774 | 8/1995 | Cole | 15/167.1 |
| 5,465,450 | 11/1995 | Humphries | 15/167.1 |

FOREIGN PATENT DOCUMENTS

| | | | |
|---|---|---|---|
| 0640683 | 12/1963 | Belgium . | |
| 0023407 | 2/1981 | European Pat. Off. . | |
| 0671956 | 12/1929 | France . | |
| 302119 | 1/1937 | Italy | 15/167.2 |
| 0000745 | 1/1986 | United Kingdom . | |

*Primary Examiner*—Gary K. Graham

*Attorney, Agent, or Firm*—Dann, Dorfman, Herrell and Skillman, P.C.

[57] ABSTRACT

A toothbrush is disclosed having a brush head that includes a flexible member formed for resilient flexure between a first shape and a second shape. The flexible member has first and second sides and a central bristle support portion disposed between first and second outer bristle support portions. The flexible member also has an elastic portion interconnecting the central bristle support portion to the first and second bristle support portions along lateral edges thereof. The toothbrush further includes a pair of handle extensions for supporting the flexible member at the first and second sides thereof such that the flexible member is free to flex between first and second shapes when stressed. An array of first bristle tufts is attached to the central bristle support portion. First and second arrays of second bristle tufts are attached to the first and second outer bristle support portions, respectively, and are aligned in parallel relation to the array of first bristle tufts. The first and second arrays of second bristle tufts are dimensioned and positioned relative to the array of first bristle tufts such that when the first bristle tufts are pressed against the biting surface of a tooth, the flexible member is caused to change its size and shape whereby the first and second arrays of second bristle tufts incline toward the array of first bristle tufts.

16 Claims, 4 Drawing Sheets

FIG. 1
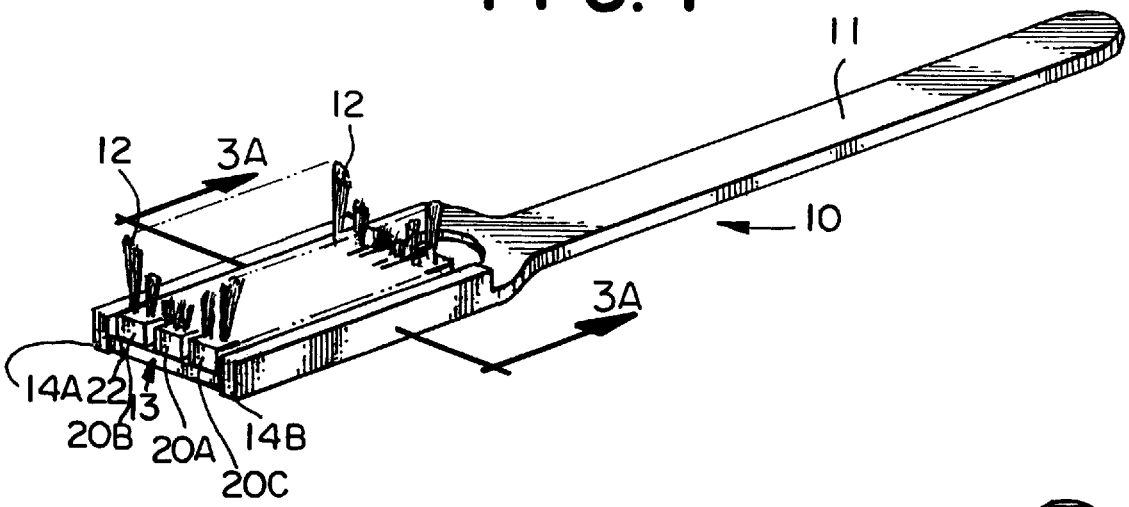
FIG. 2
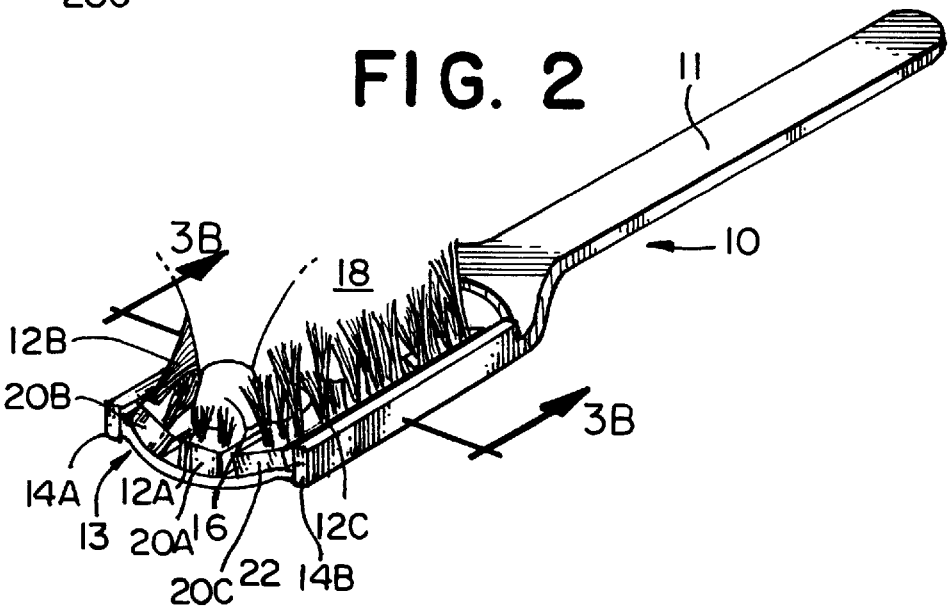
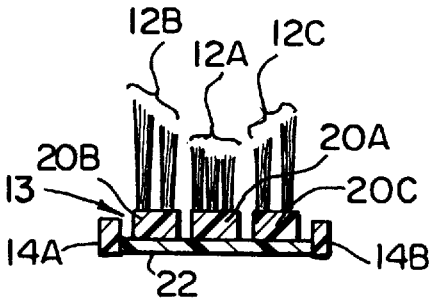
FIG.3A
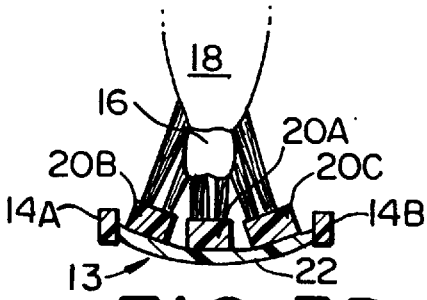
FIG. 3B

TOOTHBRUSH WITH RESILIENT FLEXIBLE BRISTLE SUPPORT

FIELD OF THE INVENTION

This invention relates to toothbrushes and, more particularly, to a toothbrush in which the bristles are supported on a resilient, readily flexed member so as to provide effective, simultaneous cleaning of both the teeth and gums.

BACKGROUND OF THE INVENTION

U.S. Pat. Nos. 5,355,546 and 5,483,722 relate to a toothbrush which is suited for simultaneous cleaning of the opposite sides of teeth, including the areas below the adjacent gums. A unique feature of the toothbrush described in those patents is an arrangement in which the bristle tufts are mounted on a readily flexed resilient member, shown therein in the form of an elongated sheet. When the central portion of the brush is pressed against the teeth, the resilient member is readily displaced from its normal rest or starting position, causing the outer bristles to incline toward the center of the brush head, and thereby bringing the free ends of the outer bristles into engagement with the sides of the teeth and the adjacent gums. At least some of the bristles on each side of an engaged tooth are optimally directed into engagement with the gingival sulcus area under the gum at the base of the tooth.

In practice, it has proved difficult to reliably attach the bristles to an elongated sheet of the flexible resilient material. Accordingly, a need has arisen for a practical way to attach the bristles to the flexible resilient member that provides reliable retention of the bristles during use and yet permits the easy flexure of the bristle support member that is necessary for the effective use of the toothbrush.

SUMMARY OF THE INVENTION

The problem encountered with the known toothbrushes as described above, is overcome to a large degree by a toothbrush in accordance with the present invention. The toothbrush of this invention includes a flexible member formed for resilient flexure between a first shape and a second shape. The flexible member has first and second sides and a central bristle support portion disposed between first and second outer bristle support portions. The flexible member also has one or more elastic portions interconnecting the central bristle support portion to the first and second bristle support portions along lateral edges thereof.

A toothbrush according to this invention also has a pair of support members for supporting the flexible member at the first and second sides thereof such that the flexible member is free to flex between said first and second shapes when stressed. An array of first bristle tufts is attached to the central bristle support portion. A first array of second bristle tufts is attached to the first outer bristle support portion and a second array of second bristle tufts is attached to the second outer bristle support portion. The first and second arrays of second bristle tufts are aligned in parallel relation to the array of first bristle tufts. The second bristle tufts are longer than the first bristle tufts and are unconstrained from inclining relative to the array of first bristle tufts. The first and second arrays of second bristle tufts are dimensioned and positioned relative to the array of first bristle tufts such that when the first bristle tufts are pressed against the biting surface of a tooth, the flexible member is caused to change its size and shape whereby the first and second arrays of second bristle tufts are caused to incline toward the array of first bristle tufts such that, simultaneously with the first bristle tufts engaging the biting surface of the tooth, the first and second arrays of second bristle tufts contact the inner and outer sides respectively of the tooth and the gums adjacent thereto.

BRIEF DESCRIPTION OF THE DRAWINGS

The foregoing summary as well as the following detailed description of preferred embodiments of the present invention will be better understood when read in conjunction with the appended drawings, wherein:

FIG. 1 is a perspective view of a toothbrush according to the present invention showing the resilient, flexible member in an unflexed state;

FIG. 2 is a perspective view of the toothbrush of FIG. 1 showing the bristles in engagement with a user's teeth and the resilient, flexible member in a flexed state;

FIG. 3A is an elevation view showing a cross section of the toothbrush of FIG. 1 as viewed along line 3A—3A therein;

FIG. 3B is an elevation view showing a cross section of the toothbrush of FIG. 2 as viewed along line 3B—3B therein;

DETAILED DESCRIPTION

Figure 4A:
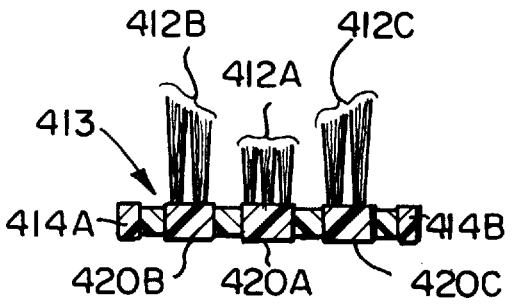
FIG. 4A is an elevation view showing a cross section of a second embodiment of toothbrush according to the present invention.

Referring now to the drawings wherein like reference numerals refer to the same or similar elements among the several figures, and in particular to FIGS. 1 and 2, there is shown a toothbrush 10 in accordance with the present invention. The toothbrush 10 has a handle 11 and a plurality of bristles 12. The bristles 12 are carried by a resilient flexible member 13 which is supported along its sides by extensions 14A and 14B of handle 11. The general structure of the toothbrush 10 is essentially the same as that described in U.S. Pat. Nos. 5,355,546 and 5,483,722, the disclosures of which are incorporated herein by reference.

As described in those patents, the bristles 12 are composed of a central bristle array 12A, and first and second outer bristle arrays 12B and 12C. With reference to FIG. 2 of the present application, the toothbrush 10 is used by bringing the central bristle array 12A against the biting surface of a tooth 16 and then pressing the handle extensions 14A and 14B in a direction to press the central bristle array 12A against the biting surface of the tooth 16. Sufficient pressure is applied to stress the flexible member 13, causing it to stretch so as to change its size and shape thereby causing the outer bristle arrays 12B and 12C to incline toward the central bristle array 12A. In this manner, simultaneously with the central bristle array 12A engaging the biting surface of the tooth 16, the outer bristle array 12B contacts the inner surface of the tooth 16 and the gums 18 adjacent thereto, and the outer bristle array 12C contacts the outer surface of the tooth and the gums adjacent thereto.

Referring now to FIGS. 3A and 3B, there is shown a first embodiment of an arrangement of the bristle arrays 12A, 12B, and 12C and the flexible member 13. The flexible member 13 includes a central bristle support member 20A and outer bristle support members 20B and 20C which are affixed to a surface of an elastic member 22. Elastic member 22 is formed of a thin, sheet-like piece of an elastomeric material that can temporarily change in shape and size and which has other properties that are suitable for the intended use. Such elastomeric materials include low or high density polyethylene, tetrafluoroethylene, polyurethane, polypropylene, and the like. The bristle support members are preferably formed of a rigid or semi-rigid plastic material such as ultrahigh, high, or low density polystyrene, polypropylene, polyethylene, polyacetal, and similar plastic materials. The bristle support members extend longitudinally in parallel, spaced relation on the elastic member and are substantially commensurate in length therewith. The arrays of bristle tufts 12A, 12B, and 12C are secured to the bristle support members 20A, 20B, and 20C, respectively, in any suitable manner. For example, mechanical, adhesive, or fusion means can be used, as well as combinations thereof or injection molding techniques.

The bristle support members 20A, 20B, and 20C are attached to the surface of the elastic member 22 by a suitable adhesive or fusion bonding. The nature of the attachment method is selected such that the bristle support member remains bonded to the elastic member 22 as the elastic member changes its size and shape during use. The flexible member 13 is attached to the extensions 14A and 14B in any convenient manner. As shown in FIGS. 3A and 3B, the lateral edges of elastic member 22 are bonded to facing edges of the extensions 14A and 14B. Alternatively, the elastic member 22 is attached to the top edges of extensions 14A and 14B, as shown in FIGS. 1 and 2.

Figure 4B:
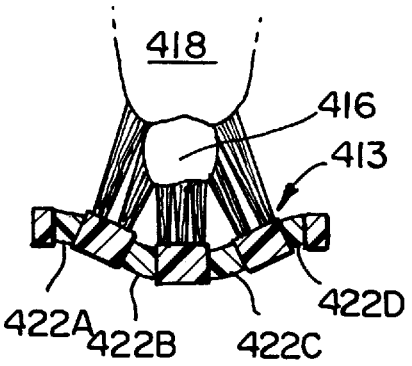
FIG. 4B is an elevation view in cross-section of the toothbrush of FIG. 4A in the flexed state.

Referring now to FIGS. 4A and 4B, there is shown a second arrangement of bristle arrays 412A, 412B, and 412C and flexible member 413. This embodiment is similar to that shown in FIGS. 1 and 2 except that the elastic member is divided into segments 422A, 422B, 422C, and 422D. Elastic segment 422A is attached between the outer lateral edge of outer bristle support member 420B and support member 414A. Elastic segment 422B is attached between the facing lateral edges of central bristle support member 420A and outer bristle support member 420B. Elastic segment 422C is attached to the facing lateral edges of central bristle support member 420A and outer bristle support member 420C and elastic segment 422D is attached between the outer lateral edge of outer bristle support member 420C and support member 414B.

Figure 5A:
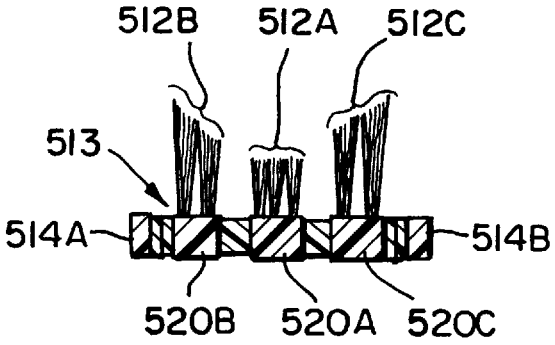
FIG. 5A is an elevation view showing a cross section of a third embodiment of the toothbrush according to the present invention.
Figure 5B:
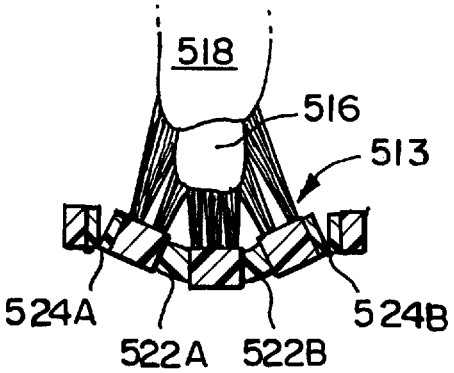
FIG. 5B is an elevation view showing a cross section of the toothbrush of FIG. 5A in the flexed state.

Referring now to FIGS. 5A and 5B, there is shown a third arrangement of bristle arrays 512A, 512B, and 512C and flexible member 513. This embodiment is similar to that shown in FIGS. 4A and 4B except that the elastic member is composed of elastic segments 522A and 522B and plastic hinges 524A and 524B. Plastic hinge 522A is attached between the outer lateral edge of outer bristle support member 520B and support member 514A. Elastic segment 522A is attached between the facing lateral edges of central bristle support member 520A and outer bristle support member 520B. Elastic segment 522B is attached to the facing lateral edges of central bristle support member 520A and outer bristle support member 520C. Plastic hinge 524B is attached between the outer lateral edge of outer bristle support member 520C and support member 514B.

Figure 6A:
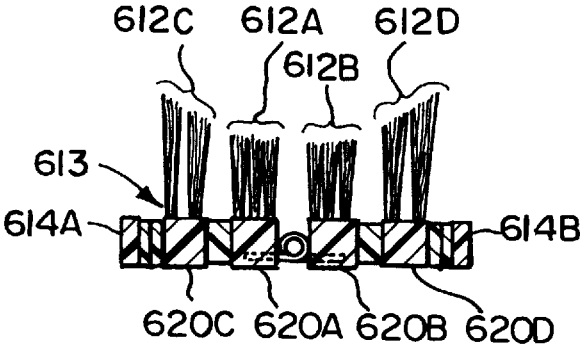
FIG. 6A is an elevation view showing a cross section of a fourth embodiment of the toothbrush according to this invention.
Figure 6B:
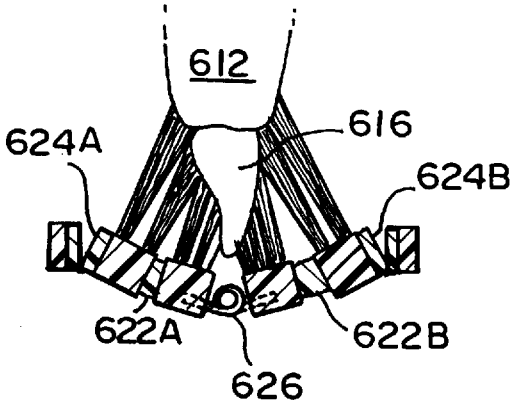
FIG. 6B is an elevation view in cross section of the toothbrush of FIG. 6A in the flexed state.

Referring now to FIGS. 6A and 6B, there is shown a fourth arrangement of bristle arrays 612A, 612B, 612C and 612D and flexible member 613. This embodiment is similar to that shown in FIGS. 5A and 5B except that the elastic member is composed of elastic segments 622A and 622B, plastic hinges 624A and 624B, and a torsion spring 626. Also, there are two central bristle support members 620A and 620B in addition to the two outer bristle support members 620C and 620D. Plastic hinge 624A is attached between the outer lateral edge of outer bristle support member 620C and support member 614A. Elastic segment 622A is attached between the facing lateral edges of central bristle support member 620A and outer bristle support member 620C. Elastic segment 622B is attached between facing lateral edges of central bristle support member 620B and outer bristle support member 620D. Plastic hinge 624B is attached between the outer lateral edge of outer bristle support member 620D and support member 614B. Torsion spring 626 is attached between facing lateral edges of central bristle support members 620A and 620B.

Figure 7A:
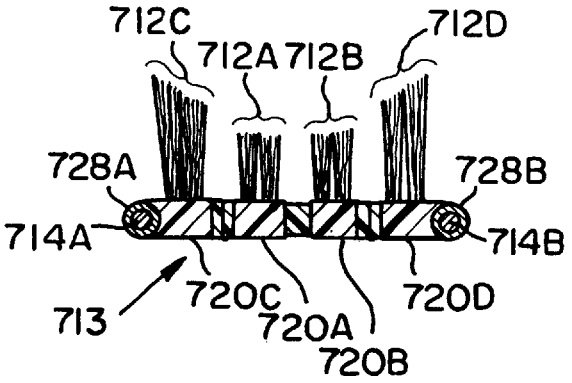
FIG. 7A is an elevation view showing a cross section of a fifth embodiment of the toothbrush according to the present invention.
Figure 7B:
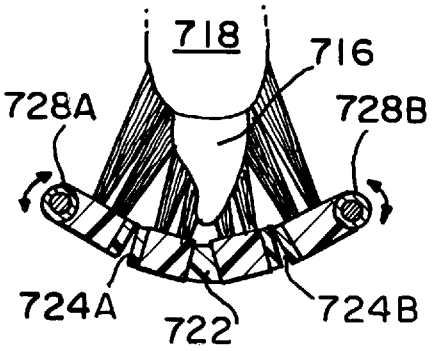
FIG. 7B is an elevation view in cross section of the toothbrush of FIG. 7A in the flexed state.

Referring now to FIGS. 7A and 7B, there is shown a fifth arrangement of bristle arrays 712A, 712B, 712C and 712D and flexible member 713. In this embodiment the elastic member is composed of a single elastic segment 722, plastic hinges 724A and 724B, and a pair of tubular sleeves 728A and 728B. There are two central bristle support members 720A and 720B in addition to the two outer bristle support members 720C and 720D. Tubular sleeve 728A is attached to an outer edge of outer bristle support member 720C and has an inner diameter that is dimensioned to receive handle extension 714A such that sleeve 728A can easily rotate around extension 714A. Alternatively, the tubular sleeve 728A can be formed integrally with outer bristle support member 720C. Plastic hinge 724A is attached between the facing lateral edges of outer bristle support member 720C and central bristle support member 720A. Elastic segment 722 is attached between the facing lateral edges of central bristle support members 720A and 720B. Plastic hinge 724B is attached between the facing lateral edges of outer bristle support member 720D and central bristle support member 720B. Tubular sleeve 728B is attached to an outer edge of outer bristle support member 720D in a manner similar to tubular sleeve 728A is attached to outer bristle support member 720C so that it is free to rotate around handle extension 714B. In the embodiment shown in FIGS. 7A and 7B, the extensions 714A and 714B are rod-like in shape so as to provide ease of rotation of the tubular sleeves 728A and 728B. In this arrangement the flexible member 713 is not fixedly attached to the extensions 714A and 714B, therefore, the ends of the extensions away from the toothbrush handle include retaining means to prevent the sleeves 728A and 728B from sliding off the open ends of the extensions during use of the toothbrush.

Figure 8A:
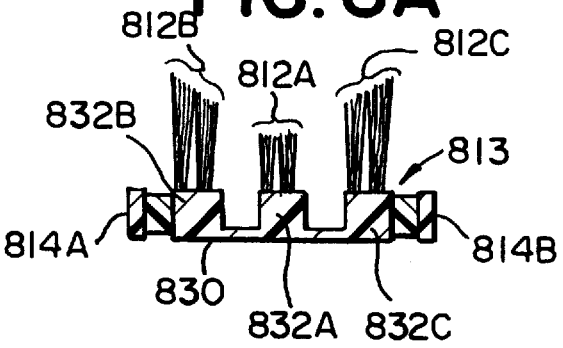
FIG. 8A is an elevation view showing a cross section of a sixth embodiment of the toothbrush according to this invention.
Figure 8B:
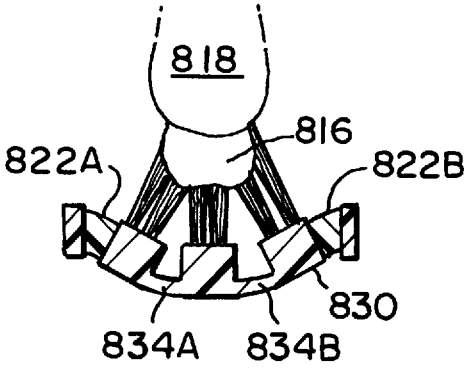
FIG. 8B is an elevation view showing a cross section of a the toothbrush of FIG. 8A in the flexed state.
Figure 8C:
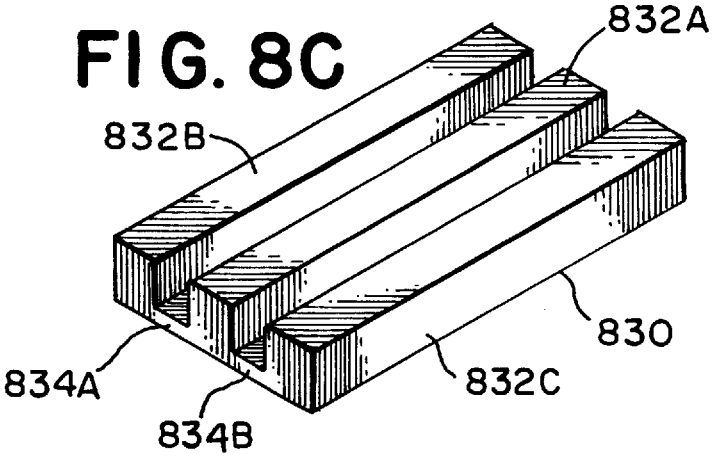
FIG. 8C is a perspective view of a bristle support member used in the toothbrush shown in FIGS. 8A and 8B.

Referring now to FIGS. 8A and 8B, there is shown a sixth arrangement of bristle arrays 812A, 812B, and 812C and flexible member 813. In this embodiment the flexible member 813 is composed of elastic segments 822A and 822B and a unitary bristle support member 830. Elastic segment 822A is attached between one lateral edge of bristle support member 830 and handle extension 814A. Elastic segment 822B is attached between the other lateral edge of bristle support member 830 and extension 814B. The construction of bristle support member 830 can be better understood with reference to FIG. 8C.

The bristle support member 830 is formed of a single piece of a semi-rigid, plastic material. A central rib 832A is disposed between outer ribs 832B and 832C. As shown in FIGS. 8A and 8B, the central bristle array 812A is affixed to central rib 832A, and the outer bristle arrays 812B and 812C are affixed to outer ribs 832B and 832C, respectively. The ribs 832A, 832B, and 832C are interconnected by thin portions 834A and 834B, thin portion 834A being disposed between ribs 832A and 832B, and thin portion 834B being disposed between ribs 832A and 832C. The thickness of the thin portions 834A and 834B is selected such that they can flex and bend sufficiently to provide the desired inclination of the outer ribs 832B, 832C and bristle arrays 812B, 812C, without creasing, when pressure is applied to rib 832A as central bristle array 821A is pressed against the biting surface of tooth 816.

Figure 9A:
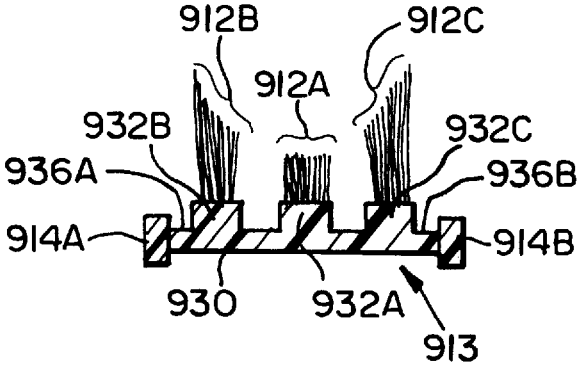
FIG. 9A is an elevation view showing a cross section of a further embodiment of the toothbrush according to this invention.
Figure 9B:
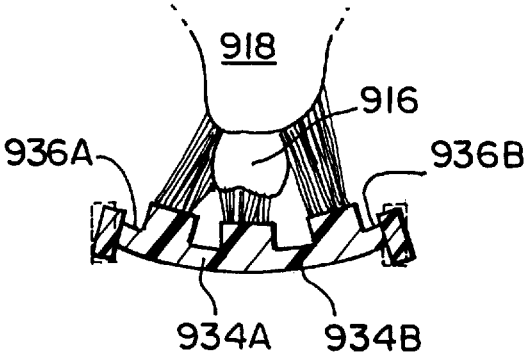
FIG. 9B is an elevation view in cross section of the toothbrush of FIG. 9A.

Referring now to FIGS. 9A and 9B, there is shown a further arrangement of bristle arrays 912A, 912B, and 912C and a flexible member 913. In this embodiment the flexible member 913 is constructed of a unitary bristle support member 930 attached between handle extensions 914A and 914B. The construction of bristle support member 930 is essentially the same as that described for the embodiment of FIG. 8C. In that regard, the bristle support member 930 is formed of a single piece of a semi-rigid, plastic material. A central rib 932A is disposed between outer ribs 932B and 932C. As shown in FIGS. 9A and 9B, the central bristle array 912A is affixed to central rib 932A, and the outer bristle arrays 912B and 912C are affixed to outer ribs 932B and 932C, respectively. The ribs 932A, 932B, and 932C are interconnected by thin portions 934A and 934B. A thin portion 934A is disposed between ribs 932A and 932B, and a second thin portion 934B is disposed between ribs 932A and 932C. The thickness of the thin portions 934A and 934B is selected such that they can flex and bend sufficiently to provide the desired inclination of the outer ribs 932B, 932C and bristle arrays 912B, 912C, without creasing, when pressure is applied to rib 932A as central bristle array 912A is pressed against the biting surface of tooth 916.

In the embodiment of FIGS. 9A and 9B, the bristle support member 930 includes additional thin portions 936A and 936B. Those thin portions extend from the outer ribs 932B and 932C, respectively, for attaching the bristle support member 930 to the handle extensions 914A and 914B, respectively. Alternatively, the thin portions 936A and 936B need not be used. Instead, the outer edges of ribs 934B and 934C can be attached directly to the handle extensions. In either case, attachment is effected by using a suitable adhesive or by fusion bonding, or the bristle support member and the handle extensions can be molded as an integral piece.

The flexible member 913 does not have any elastic portions to cause the bristle support member 930 to revert to its normal, non-flexed condition. Therefore, the handle extensions are formed of a resilient material that provides good torsional resilience. Thus, when the central bristle array 912A is pressed against the tooth 916, the handle extensions 914A and 914B twist about their respective long axes to permit the bristle support member 930 to deflect in the desired manner. However, when the pressure is withdrawn, the handle extensions twist back to their initial state, thereby causing the bristle support member to return to the unflexed condition. The handle extension material is also sufficiently rigid to resist bending when the bristle arrays 912A, 912B, and 912C are pressed against the teeth and gums during use.

In the several embodiments described above and shown in the various drawing figures, the elastic segments and/or plastic hinges that interconnect the bristle support members and the extensions are attached thereto by any suitable adhesive or by fusion bonding. The nature of the attachment method is selected such that the handle extension and the bristle support member remain bonded to the elastic segment or plastic hinge as the flexible member changes in size and shape during use. Moreover, although the embodiments of the present invention have been described with reference to an arrangement wherein the flexible member is relatively flat in the normal state, it is also contemplated that the flexible member can be in an arcuate shape in the normal state as shown and described in the U.S. patents which are incorporated by reference hereinabove.

The terms and expressions which have been employed are used as terms of description and not of limitation. There is no intention in the use of such terms and expressions of excluding any equivalents of the features shown and/or described, or portions thereof. It is to be recognized that various modifications are possible within the scope of the invention claimed.

What is claimed is:

1. A toothbrush comprising:

a flexible member formed for resilient flexure between a first shape and a second shape, said flexible member having first and second sides and a central bristle support portion disposed between first and second outer bristle support portions, said bristle support portions being formed of a substantially rigid material, said flexible member also having an elastic portion interconnecting said central bristle support portion to said first and second bristle support portions along lateral edges thereof;

a pair of support members for supporting said flexible member at the first and second sides thereof such that said flexible member is free to flex between said first and second shapes when stressed;

an array of first bristle tufts attached to said central bristle support portion;

a first array of second bristle tufts attached to the first outer bristle support portion and aligned in parallel relation to said first bristle tufts; and a second array of second bristle tufts attached to the second outer bristle support portion and aligned in parallel relation to said first bristle tufts;

said second bristle tufts being longer than said first bristle tufts and being unconstrained from inclining relative to said array of first bristle tufts;

wherein said first and second arrays of second bristle tufts are dimensioned and positioned relative to said array of first bristle tufts such that when the first bristle tufts are pressed against the biting surface of a tooth, said flexible member is caused to change its size and shape whereby said first and second arrays of second bristle tufts are caused to incline toward the array of first bristle tufts such that, simultaneously with the first bristle tufts engaging the biting surface of the tooth, said first and second arrays of second bristle tufts contact the inner and outer sides respectively of the tooth and adjacent gums.

2. A toothbrush as recited in claim 1 wherein said elastic portion is formed of a resilient sheet material and said central and outer bristle support portions are affixed to a surface of the resilient sheet material in spaced parallel relation to each other.

3. A toothbrush as recited in claim 1 wherein said central and outer bristle support portions are aligned in spaced parallel relation to each other and said elastic portion comprises segments of resilient sheet material attached between facing lateral edges of said central and outer bristle support members.

4. A toothbrush as recited in claim 3 wherein said flexible member comprises a first hinge affixed to an outward lateral edge of said first outer bristle support portion and a second hinge affixed to an outward lateral edge of said second outer bristle support portion, said first and second hinges being attached to respective ones of said support members.

5. A toothbrush as recited in claim 4 wherein said first and second hinges are formed of plastic.

6. A toothbrush as recited in claim 1 wherein said flexible member comprises first and second tubular sleeves disposed along the first and second sides respectively of said flexible member, said first and second tubular sleeves being disposed around respective ones of said support members and each having an inner diameter dimensioned to permit each of said tubular sleeves to rotate freely about its respective support member.

7. A toothbrush as recited in claim 6 wherein the first tubular sleeve is affixed to said first outer bristle support member and the second tubular sleeve is affixed to said second outer bristle support member.

8. A toothbrush as recited in claim 6 wherein the first and second tubular sleeves are formed integrally with said first and second outer bristle support members, respectively.

9. A toothbrush comprising:

a flexible member formed for resilient flexure between a first shape and a second shape, said flexible member having first and second sides and first and second central bristle support portions disposed between first and second outer bristle support portions, all of said bristle support portions being formed of a substantially rigid material, said flexible member also having elastic portions interconnecting said first and second central bristle support portions and said first and second outer bristle support portions along lateral edges thereof;

a pair of support members for supporting said flexible member at the first and second sides thereof such that said flexible member is free to flex between said first and second shapes when stressed;

a first array of first bristle tufts attached to said first central bristle support portion;

a second array of first bristle tufts attached to said second central bristle support portion;

a first array of second bristle tufts attached to the first outer bristle support portion and aligned in parallel relation to said first bristle tufts; and a second array of second bristle tufts attached to the second outer bristle support portion and aligned in parallel relation to said first bristle tufts;

said second bristle tufts being longer than said first bristle tufts and being unconstrained from inclining relative to said array of first bristle tufts;

wherein said first and second arrays of second bristle tufts are dimensioned and positioned relative to said first and second arrays of first bristle tufts such that when the first bristle tufts are pressed against the biting surface of a tooth, said flexible member is caused to change its size and shape whereby said first and second arrays of second bristle tufts are caused to incline toward the first and second arrays of first bristle tufts such that, simultaneously with the first bristle tufts engaging the biting surface of the tooth, said first and second arrays of second bristle tufts contact the inner and outer sides respectively of the tooth and adjacent gums.

10. A toothbrush as recited in claim 9 wherein the elastic portion between said first and second central bristle support members is a torsion spring.

11. A toothbrush as recited in claim 10 wherein said flexible member comprises a first hinge affixed to an outward lateral edge of said first outer bristle support portion and a second hinge affixed to an outward lateral edge of said second outer bristle support portion, said first and second hinges being attached to respective ones of said support members.

12. A toothbrush as recited in claim 11 wherein said hinges are formed of plastic.

13. A toothbrush as recited in claim 9 wherein the elastic portions between said first central bristle support member and said first outer bristle support member and between said second central bristle support member and said second outer bristle support member are plastic hinges.

14. A toothbrush as recited in claim 13 wherein said flexible member comprises first and second tubular sleeves affixed to outward edges of said first and second outer bristle support members, respectively, said first and second tubular sleeves being disposed around respective ones of said support members and each having an inner diameter dimensioned to permit each of said tubular sleeves to rotate freely about its respective support member.

15. A toothbrush comprising:

a flexible member formed for resilient flexure between a first shape and a second shape, said flexible member having first and second sides and a bristle support member disposed between first and second elastic members attached to said bristle support member along lateral edges thereof, said bristle support member including a rigid central rib disposed between rigid first and second outer ribs, said ribs being interconnected by two relatively thin segments that are readily flexed when pressure is applied to the central rib;

a pair of support members for supporting said flexible member at the first and second sides thereof such that said flexible member is free to flex between said first and second shapes when stressed;

an array of first bristle tufts attached to said central rib;

a first array of second bristle tufts attached to the first outer rib and aligned in parallel relation to said first bristle tufts; and a second array of second bristle tufts attached to the second outer raised-rib portion and aligned in parallel relation to said first bristle tufts;

said second bristle tufts being longer than said first bristle tufts and being unconstrained from inclining relative to said array of first bristle tufts;

wherein said first and second arrays of second bristle tufts are dimensioned and positioned relative to said array of first bristle tufts such that when the first bristle tufts are pressed against the biting surface of a tooth, said flexible member is caused to change its size and shape whereby said first and second arrays of second bristle tufts are caused to incline toward the array of first bristle tufts such that, simultaneously with the first bristle tufts engaging the biting surface of the tooth, said first and second arrays of second bristle tufts contact the inner and outer sides, respectively, of the tooth and adjacent gums.

16. A toothbrush comprising:

a flexible member formed for flexure between a first shape and a second shape, said flexible member having first and second sides and a bristle support member including a rigid central rib disposed between rigid first and second outer ribs, said ribs being interconnected by two relatively thin segments that are readily flexed when pressure is applied to the central rib;

a pair of support members for supporting said flexible member at the first and second sides thereof such that said flexible member is free to flex between said first and second shapes when stressed, said support members being formed and dimensioned to twist resiliently about their respective long axes when said flexible member flexes to the second shape, so as to return the flexible member to its first shape when the flexible member is unstressed;

an array of first bristle tufts attached to said central rib;

a first array of second bristle tufts attached to the first outer rib and aligned in parallel relation to said first bristle tufts; and a second array of second bristle tufts attached to the second outer raised-rib portion and aligned in parallel relation to said first bristle tufts;

said second bristle tufts being longer than said first bristle tufts and being unconstrained from inclining relative to said array of first bristle tufts;

wherein said first and second arrays of second bristle tufts are dimensioned and positioned relative to said array of first bristle tufts such that when the first bristle tufts are pressed against the biting surface of a tooth, said flexible member is caused to change its shape whereby said first and second arrays of second bristle tufts are caused to incline toward the array of first bristle tufts such that, simultaneously with the first bristle tufts engaging the biting surface of the tooth, said first and second arrays of second bristle tufts contact the inner and outer sides, respectively, of the tooth and adjacent gums.

* * * * *